US005303723A

United States Patent [19]

Schach

[11] Patent Number: 5,303,723

[45] Date of Patent: Apr. 19, 1994

[54] HAIR STYLING DEVICE

[75] Inventor: Denie Schach, Richardson, Tex.

[73] Assignee: Angelhair, Ltd., Richardson, Tex.

[21] Appl. No.: 121,225

[22] Filed: Sep. 13, 1993

[51] Int. Cl.[5] ..... A45D 2/18

[52] U.S. Cl. ..... 132/246; 132/247

[58] Field of Search ..... 132/222, 246, 247, 253, 132/254, 273; 2/174

[56] References Cited

U.S. PATENT DOCUMENTS

| | | | |
|---|---|---|---|
| 347,177 | 8/1886 | Heysinger | 132/246 |
| 1,457,191 | 5/1923 | Sinclair | 132/253 |
| 2,693,809 | 11/1954 | Spencer | 132/246 |
| 4,577,647 | 3/1986 | Fenster et al. | 132/219 |
| 4,648,414 | 3/1987 | Fox et al. | 132/246 |
| 4,892,110 | 1/1990 | Harvie | 132/222 |

*Primary Examiner*—Gene Mancene
*Assistant Examiner*—Frank A. LaViola

[57] ABSTRACT

A hair styling device comprising a generally peanut-shaped outer covering of material capable of clinging to hair, at least one intermediate layer of a resilient film attached along its periphery to said outer covering to form a unitary structure, and a deformable structure in the interior of said device capable of being repeatedly bent to form said device into a variety of shapes.

5 Claims, 2 Drawing Sheets

HAIR STYLING DEVICE

BACKGROUND OF THE INVENTION

The present invention relates to a hair styling device that can be used to shape long hair into a variety of styles without the use of pins or other clamping means, or a minimum number thereof, which tend to damage the hair.

At the present time it is well known that women's long hair can be formed into a variety of styles depending upon the desires of the the particular individual. Thus, the hair can be placed into a bun or buns, ponytail, French knot, braid, cascade, and a variety of other shapes.

Such shapes can often not be made by the individual, but must be done by a hair stylist at great cost. Moreover, in order to form the hair into any of of a variety of such shapes it has also been necessary to use fastening means such as bobby pins or other rigid clamping means, in order to maintain the styled hair in place. Such bobby pins, barrettes, and the like, tend not only to be unsightly but also to damage the hair during repeated use.

Efforts to eliminate the need for such clamping means have not been entirely successful since it has not been possible to find a device which will hold the hair in the desired style while at the same time minimizing any damage to the hair.

SUMMARY OF THE INVENTION

Briefly stated, the present invention overcomes the problems of the prior art and provides a device for conveniently and rapidly styling hair without damaging the hair.

Briefly, the present invention comprises a generally peanut-shaped hair styling device comprising an outer covering of resilient material capable of clinging to hair, at least one intermediate layer of a resilient film attached along its pheriphery to said outer resilient layer to form a unitary structure, and deformable means in the interior of said device capable of being repeatedly bent to form said device into a variety of shapes.

DETAILED DESCRIPTION

Figure 1:
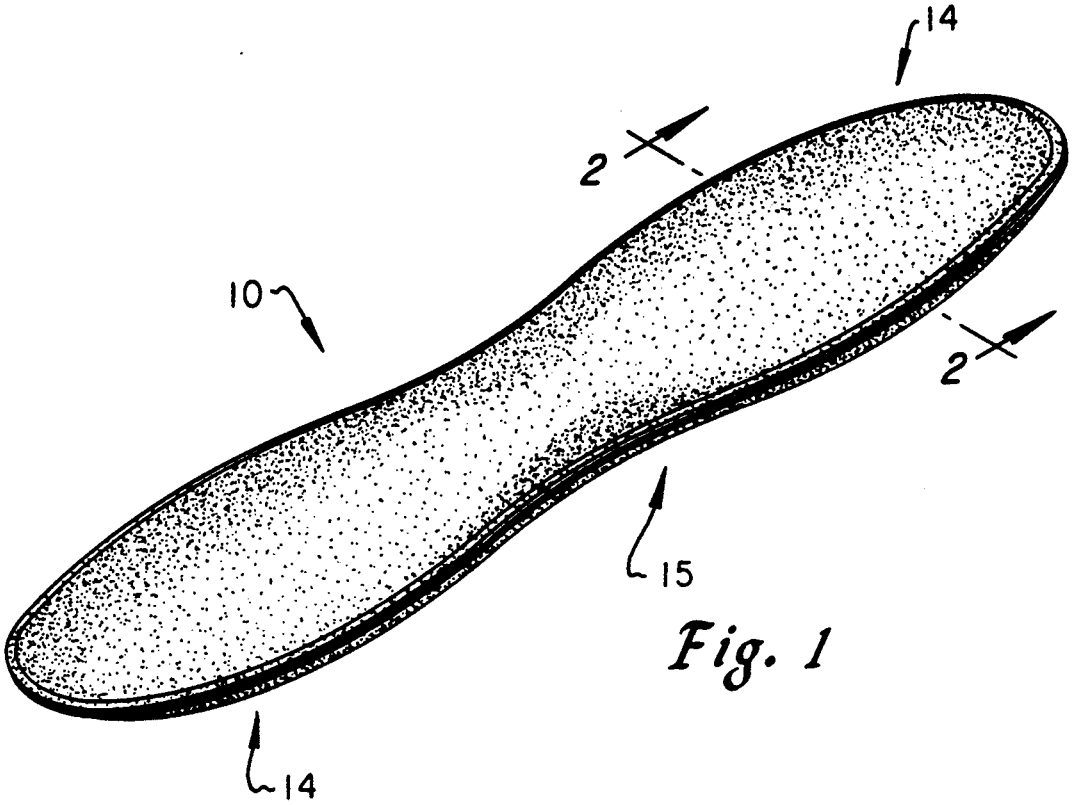
FIG. 1 is a perspective view of a hair styling device in accord with the present invention.
Figure 2:
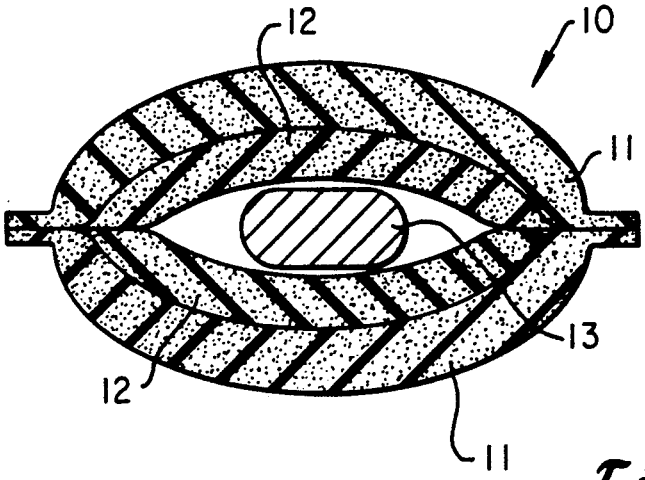
FIG. 2 is a sectional view taken alone line 2—2 of FIG. 1.

Referring to the drawings, there is shown a peanut-shaped hair styling device 10 which comprises outer resilient layers 11, intermediate film layers 12, and deformable means 13 in the interior of the device.

With respect to the outer resilient layers 11, although two separate layers are shown, a single layer can be used by being folded and the intermediate layer(s) 12 and deformable means 13 inserted therebetween. The layers 11 are formed of a resilient material capable of clinging to the hair. Such a material is most suitably any conventional polyurethane ester foam. Such material while resilient is structurally tough and, moreover, it has the ability to cling to hair.

There should also be used at least one resilient intermediate layer 12, although as depicted in the drawings, there are two intermediate layers 12 of resilient material. It is preferable to use a strong plastic film and it is preferred to utilize a film which can be heated by radio frequency and melted to fuse to itself and to the outer layer(s). For this purpose, it is preferred to use a polyvinyl chloride film. Such film also has sufficient strength to help insure that the deformable means 13 do not puncture the same and penetrate through outer layer(s) 11.

As to the deformable means 13, it is preferably any flexible metal rod, bar, or the like, made of copper, aluminum and the like which can be repeatedly bent without fracturing. It is preferred to entirely coat the metal with a plastic such as TEFLON or the like, to help insure that in the event the instant styling device is misused, there will be no metal ends or edges to possibly injure the user. While a single coated bar or rod can be used it is possible to use two or more rods encased in a plastic coating. It is only necessary that the thickness of the deformable means 13 be such as to provide extended life in terms of number of times it can be bent and that it be of a length such as to extend substantially along the entire length of the device 10.

The deformable means 12 snugly contained in the interior of device 10 such that when it is bent into various shapes it will thereby bend the device 10 into such various shapes and when bent back to its original linear shape the device 10 will assume its original linear shape.

With respect to forming device 10, the polyurethane ester foam layers 11 are first cut to the desired "peanut" shape as are film layers 12. Deformable means 13 are placed between film layers 12 and then outer layers 11 are placed over film layers 12 to form an assembly of all the three elements. Film layers 12 have radio frequency waves applied to the entire periphery thereof which acts to melt the film at such periphery and fuse it to itself and to the outer layers 11 to form a unitary device 10 with the deformable means 13 encased in the interior thereof.

It is not necessary that the layers be bonded together using heat in order to melt the PVC film since conventional adhesives or sewing can be utilized for this purpose.

The device 10 is to be in the peanut shape noted, namely two generally bulbous ends 14 joined by a narrower waist portion 15. This narrow waist portion 15 is preferred since when using device 10 with long hair a large mass of hair may gather in the center of device 10 and narrowed waist portion 15 permits such larger amount of hair to be accommodated so that the final appearance of the hair will be substantially uniform without any unsightly unevenness in hair thickness.

Figure 3A:
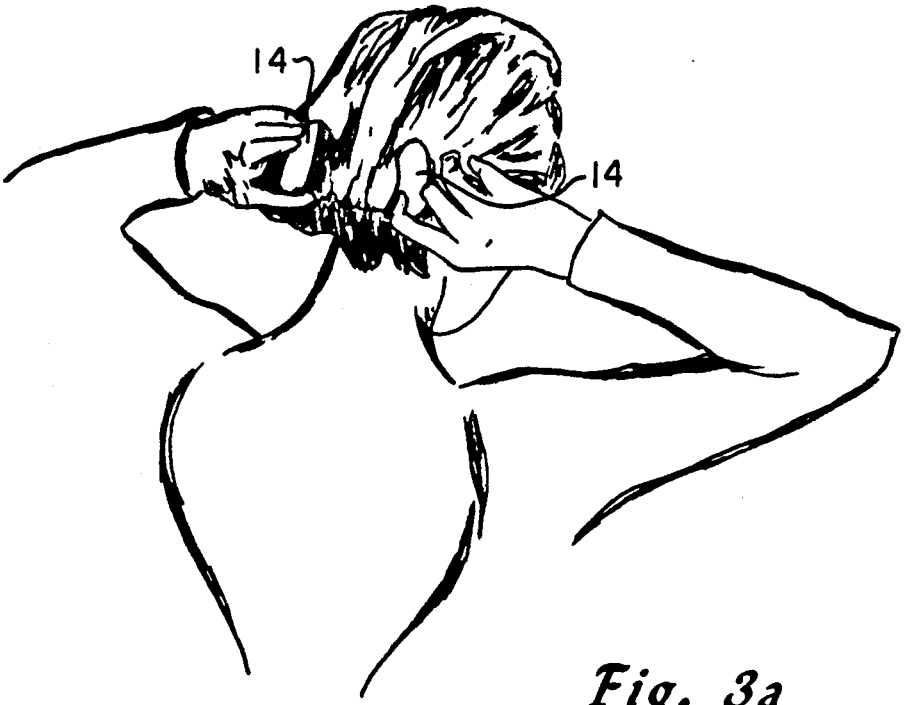
FIGS. 3(*a*) and 3(*b*) are prespective views showing how the hair styling device of the instant invention is utilized to form a bun in the hair.
Figure 3B:
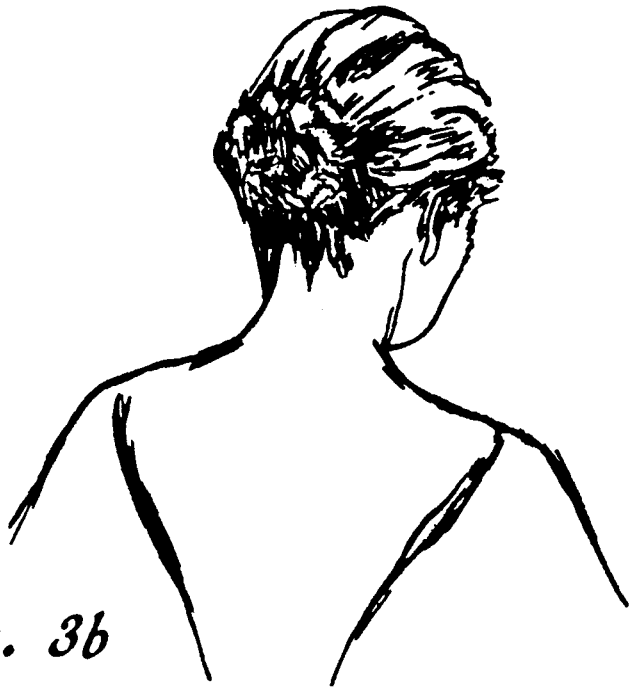

The method of using the device is illustrated in FIGS. 3*a* and 3*b* showing certain steps in the method of forming a basic bun with the basic bun shown in FIG. 3*b*. The long hair is first placed into the form of a ponytail and device 10 placed at the end thereof between the hair and the body. The device is rolled inwardly and upwardly to the point where the bun is to be located. FIG. 3*a* shows that the device has been rolled with the hair to the location where the bun is to be placed and the ends 14 of device 10 are simply bent inwardly to enclose the hair. The ends 14 are bent to form a generally circular shape and the rolled hair evenly distributed therealong to form the bun shown in FIG. 3*b*. The bun is kept in the hair without the need for any metallic or hard plastic clasping means. By simply folding the device ends 14 back to their original linear position, device 10 can be unrolled and removed from with hair.

In addition to this bun shape use of the hair, it can be used to form the hair into a variety of other shapes, as noted, such as French twists, cascades, or sprouts. All of these styles are formed by forming the hair about device 10 and maintaining the hair in the formed style by bending one or both ends 14 about the hair. With some styles it may be necessary to use one or two clamping means.

The instant device is distinguished from curlers which are used only to form a curl, but are removed for the curl to be formed. The device of the present invention remains in place and is hidden in the hair so long as the particular hair style formed is desired to be used. Also, the instant devices are quite large, being most suitably from five to nine inches or more in length, in contrast to curlers which are much smaller in length.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A hair styling device comprising a generally peanut-shaped outer covering of material capable of clinging to hair and providing a narrower waist portion to receive a larger mass of hair, at least one intermediate layer of a resilient film attached along its periphery to said outer covering to form a unitary structure, and deformable means in the interior of said device capable of being repeatedly bent to form said device into a variety of shapes.

2. The device of claim 1 wherein said outer resilient and covering is resilient and formed of a polyurethane ester foam, said at least one intermediate layer is a polyvinyl chloride film, and said deformable means is a plastic coated metal.

3. The device of claim 2 wherein the outer covering and intermediate layer are heat-sealed together at their peripheries.

4. The device of claim 1 wherein said outer covering is formed of two separate pieces and there are two intermediate layers.

5. The device of claim 4 wherein each of said pieces of said outer covering is formed of a polyurethane ester foam and each of said intermediate layers is a polyvinyl chloride film.

* * * * *